United States Patent [19]

Müller et al.

[11] 4,120,247

[45] Oct. 17, 1978

[54] CLAMP COUPLING ON A SUSPENSION GEAR OF A CIRCULAR SUSPENSION RAILWAY

[75] Inventors: Werner A. Müller, Bern; Hans Abegglen, Hinterkappelen, both of Switzerland

[73] Assignee: Von Roll AG, Departement Bahn- und Stahlbau, Bern, Switzerland

[21] Appl. No.: 775,878

[22] Filed: Mar. 9, 1977

[30] Foreign Application Priority Data

Feb. 15, 1977 [CH] Switzerland ..... 1851/77

[51] Int. Cl.[2] ..... B61B 12/12

[52] U.S. Cl. ..... 104/208; 104/173 ST; 104/216

[58] Field of Search ....., 104/173 R, 173 ST, 202, 104/204, 208, 211, 216, 223

[56] References Cited

U.S. PATENT DOCUMENTS

| | | | |
|---|---|---|---|
| 806,637 | 12/1905 | Case | 104/208 |
| 1,392,978 | 10/1921 | Tamamura | 104/208 |
| 1,481,746 | 1/1924 | Sackett | 104/208 |

FOREIGN PATENT DOCUMENTS

| | | | |
|---|---|---|---|
| 861,392 | 1/1953 | Fed. Rep. of Germany. | |
| 32,865 | 10/1884 | Fed. Rep. of Germany | 104/202 |
| 243,060 | 11/1925 | United Kingdom | 104/208 |
| 266,915 | 3/1927 | United Kingdom | 104/208 |

*Primary Examiner*—Albert J. Makay
*Assistant Examiner*—Carl Rowold
*Attorney, Agent, or Firm*—McNenny, Pearne, Gordon, Gail, Dickinson & Schiller

[57] ABSTRACT

There is disclosed a clamp coupling wherein the coupling of the suspension gear of a cable car to the haulage-and-support cable is effected and sustained as a result of the net weight of the suspension gear. The coupling includes a fixed clamp jaw affixed to a rack, a movable clamp jaw mounted on the rack, and a toggle lever mechanism supported on the rack. The mechanism is connected to a suspension gear support bar and a control car. Levers of the toggle lever mechanism are mounted by means of universal joints on the part of the rack that is distant from the clamp jaws and on the movable clamp jaw. The levers are rotatingly hinged to one another about an axis which extends at right angles to the axis of the support bar and also at right angles to imaginary connecting lines between the centers of the universal joints.

4 Claims, 4 Drawing Figures

CLAMP COUPLING ON A SUSPENSION GEAR OF A CIRCULAR SUSPENSION RAILWAY

This invention relates to a clamp coupling on a suspension gear of a circular suspension railway.

In known clamp devices, power applied to the clamp jaws is generated either by spring accumulators or by the weight of the transport container. In addition, the landing wheels or skids required for going into stations, particularly in single cable circular railways, are securely fastened to the clamps or to the part carrying the clamps, so that the longitudinal axis of the clamp always runs parallel or at a small angle to the longitudinal axis of the traveling gear.

Known disadvantages of the spring clamps are that: (1) the weight of the springs producing the clamp strength must constantly be dragged along at the expense of the payload; (2) in most known models there is a marked decrease in resilience as a result of a slackening when the cable diameter becomes narrower due to wear and tear; (3) considerable force has to be exerted on the couplings and clamps in order to press the springs in far enough for the clamp to release the cable and the kinetic energy in the vehicle is often not sufficient to effect that result and the (4) springs lose some of their tension as time goes on.

As has been proved, the known net weight clamp devices, despite their advantages, have not been entirely successful. The elimination of breakdowns in the comparatively complicated construction of the equipment, involving a high degree of precision, calls for well qualified personnel who are often not available on short notice in the often remote regions where cable railways are to be found. It has also been found that as clamp mechanics become complicated, the mechanism has to be worked on very carefully, and the mechanism reacts very sensitively and negatively to deterioration of the cable if only the net weight of the transport container is utilized to effect the clamping action.

For the automatic closing and opening of the clamp device, there is a rail set-up in the stations to which or from which the control car carried by the clamp device runs. The carrying rail forms a predetermined angle with the cable at the stations so that the control car tips over opposite the cable at the stations. Therefore, the cable above the clamp device, which is usually rigidly connected to the wheels of the running gear, exerts force on the traveling gear, which can cause an instability, i.e., one of the wheels lifting off the rails. Furthermore, under pressure, the cable may be torn from the clamp with varying force or is driven into it.

With certain clamp couplings, the supporting bar is hinged at its upper end to an elbow lever mechanism which, when the cable section to which the coupling is clamped makes various inclines horizontally while en route, follows these inclines. The greater the incline, the smaller the weight components which can affect the elbow lever mechanism and the more reduced the effect of the clamp.

This invention relates to a clamp coupling which overcomes this unfavorable phenomenon. According to this invention, a clamp coupling is provided wherein the coupling of the suspension gear to the haulage-and-support cable occurs as a result of the net weight of the suspension gear. The coupling is kept upright by a jaw clamp affixed to a rack a movable clamp jaw on a rack, and by means of an toggle lever mechanism supported on the rack. The mechanism is connected to a suspension gear support bar and a control car. Levers of the toggle lever mechanism are mounted by means of a spherical or universal joint on the part of the rack that is distant from the clamp jaws and on the mobile clamp jaw. The levers are rotatingly hinged to one another around an axis which extends at right angles to the axis of the support bar and also at right angles to the connecting lines between the centers of the spherical or universal joints.

In a clamp device of this kind described in West German patent No. 861.392, both levers of the toggle lever mechanism are mounted next to each other inside a reduced portion of the support bar by means of an axle bolt, which also serves to transfer the weight of the suspension gear to the toggle lever mechanism for which purpose the ends of this bolt sit in the parts of the support bar adjacent to the reduced portion. Apart from the fact that as a result of the reduced portion the support bar is considerably weakened and, furthermore, because of the arrangement of the toggle lever mechanism in a mobile casing on the support bar the levers of this mechanism must be very short and have a small cross section, the main disadvantage of this known construction is that both levers of the toggle lever mechanism are hinged to the support bar by the previously mentioned axle bolt. This means that only the weight of the suspension gear (including that of the support bar and control car) affects the clamping on the toggle lever mechanism. This necessarily means that an adequate clamping effect can only be obtained in that opposite position of the two levers in which their aperture angle is dangerously close to 180°. If, as a result of wear and tear, e.g., to the cable and/or to at least one of the clamp jaws, this angle of aperture can reach 180° completely, this naturally results in the elbow mechanism's giving way, which is a total disaster.

The invention attempts to remedy this. The solution to the problem lies in the fact that the one of the two levers of the toggle lever mechanism which is mounted on the part of the rack remote from the clamp jaws is rigidly attached to the support bar. This makes it possible to transfer the weight momentum affecting the support bar of the suspension gear (weight × distance between support bar and support and hauling cable) to the lever to which the support bar is rigidly attached, thus increasing the clamping effect quite considerably.

In addition to this fundamental adantage, the proposed development also has the advantage that the principal parts of the clamp coupling (in the same way as the rigid attachment of the one lever to the support bar) can be developed most favorably from a durability and a production standpoint, as can easily be seen from the following examples.

For the further development of the invention, a form had to be found for such a clamp coupling which would prevent a cross wind affecting the weight momentum on the suspension gear in the direction of the lifting from partially or totally cancelling the effectiveness of the clamp coupling. It goes without saying that a fiurther development such as this demands a safety requirement of the first order.

To solve the problem, of an involuntary buckling of the toggle lever mechanism, there is provided an automatic blocking barrier and a device to use this barrier after actuation of the clamp couplig in the closing mode and to raise the barrier before actuation of the clamp coupling in the open mode.

With reference to further developments of this invention, particular reference is made to claims 3 to 6.

Two examples of the subject of this invention are now described with reference to the attached drawings, wherein FIG. 1 is a cross section along line I—I of FIG. 2, illustrating one aspect of this invention;

Figure 1:
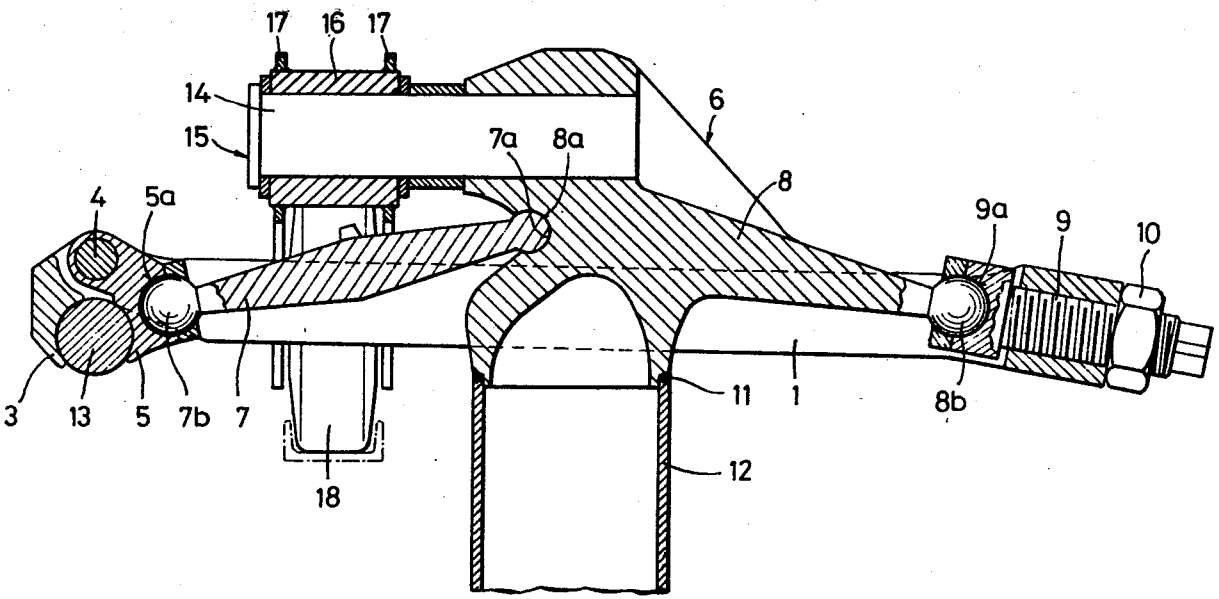
Figure 2:
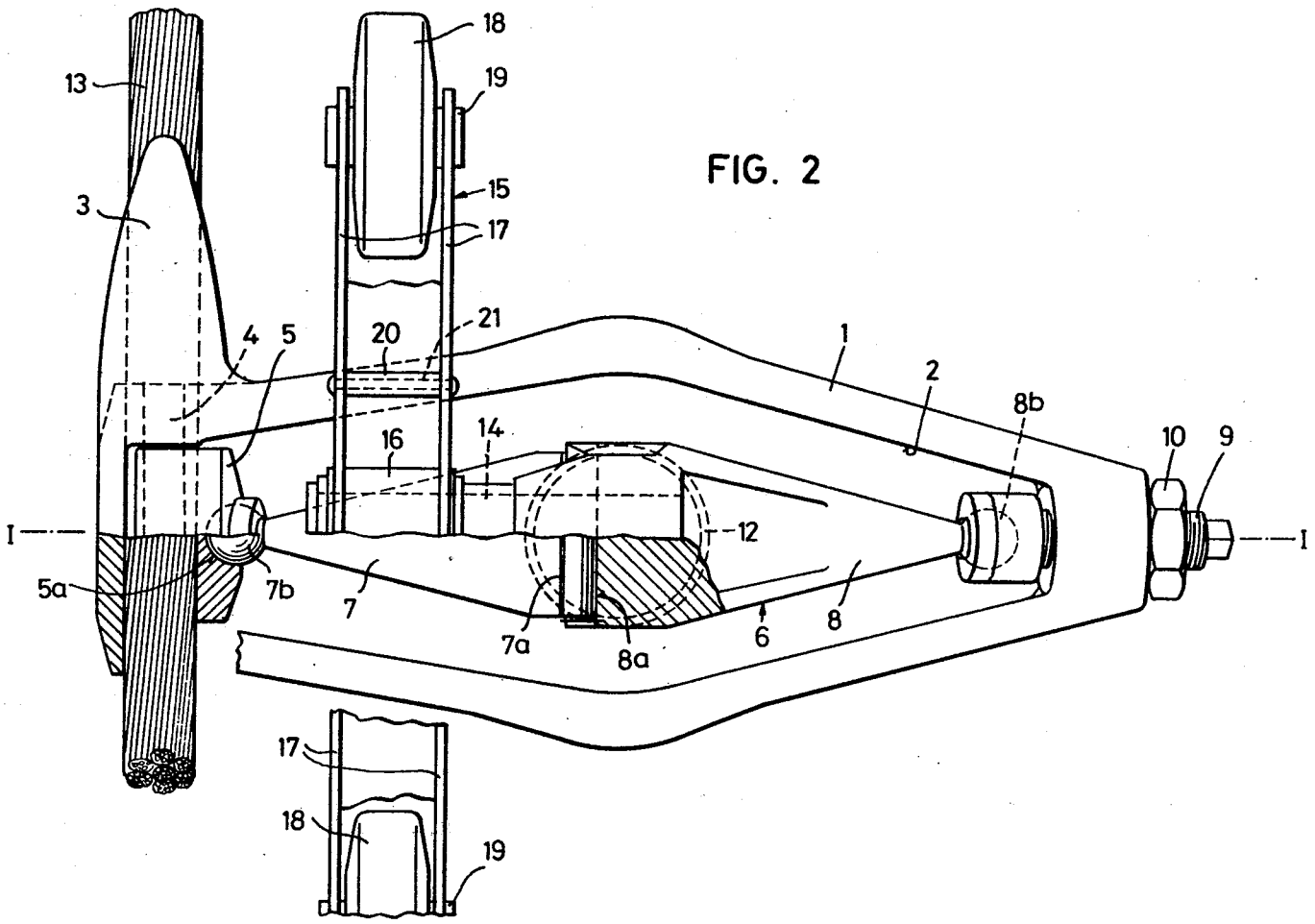
FIG. 2 is a top view, in partial section.

The clamp coupling shown in FIGS. 1 and 2 is provided on the suspension gear of a circular suspension railway for the transportation of passengers or goods. FIGS. 1 and 2 display a frame-shaped rack 1 with an opening 2. On this rack 1 is a one-piece strong clamp jaw 3 and in the vicinity of opening 2 a movable clamp jaw 5 mounted in a rotatable position by means of axle bolt 4.

Included in a mechanism 6 is a toggle lever mechanism having levers 7 and 8. The mechanism is mounted inside and on top of frame opening 2. The lever 7 is mounted by means of a convex cylindrical surface 7*a* located on it in a rotatable manner on a concave cylindrical surface 8*a*.

On its opposite end the lever 7 has a spherical head 7*b* which is mounted in a spherical joint ball socket capable of universal rotation on movable clamp jaw 5. The lever 8 also has a spherical head 8*b* on its end which is remote from the elbow joints 7*a* and 8*a*. The spherical head 8*b* is mounted for universal rotation in a spherical ball socket 9*a* provided in the head of a screw 9. The latter, after loosening of a lock nut 10, may be pushed into a thread hole located in the part of the rack remote from the clamp jaws 3, 5, and has an axis coinciding with the active line of force applied by the lever 8 .

The lever 8 is rigidly connected by means of a welded seam 11 to a support bar 12 of the suspension gear which consists of a pipe. As can easily be seen from the drawing, the axis of the toggle elbow joint 7*a*, 8*a* extends in a right angle to the axis of the support bar 12 and also in a right angle to the straight lines between the centers of the two spherical joints 5*a*, 7*b*, and 8*b*, 9*a*. Thus, when the section of the support and haulage cable 13 onto which clamp jaws 3, 5 grip changes its incline to the horizontal during the journey, the rack 1 follows these incline changes. The levers 7, 8 of elbow lever mechanism 6, because of the rigid connection of one of these levers to support bar 12, always remain in one position, in which the axis of the toggle joint 7*a*, 8*a* is horizontal and in which, therefore, the entire weight of the suspension gear is used in the clamping effort on support and haulage cable 13. It is also apparent that because support bar 12 is rigidly attached to lever 8, which is propped up on the rack 1 by means of the screw 9, and not to lever 7 which presses against clamp jaw 5, or connected hingewise to either of these levers, the weight momentum of the suspension gear (weight × distance between cable axle and support bar axle) is transferred fully to lever 8 and by means of the toggle mechanism 6 helps to increase the clamping effect which can be achieved by weight alone. Nevertheless, the suspension gear can, in the stations where it experiences delays and accelerations, swing freely around the straight lines between the centers of the two spherical joints due to the rotatability of the toggle mechanism 6. This swinging outwardly is, of course, cushioned by the friction in these spherical joints.

The part of lever 8*a* located above the toggle joint 7*a*, 8*a* has a bore hole which is at least parallel in the vicinity of the straight connecting lines just mentioned. An axle bolt 14 fits tightly into this bore hole. A control car see-saw 15, which consists mainly of the bearing sleeve 16 and rigid metal parts 18, and which supports the two overrun rollers 17 by means of axle bolts, is mounted so as to be able to rotate freely but without sliding.

Figure 3:
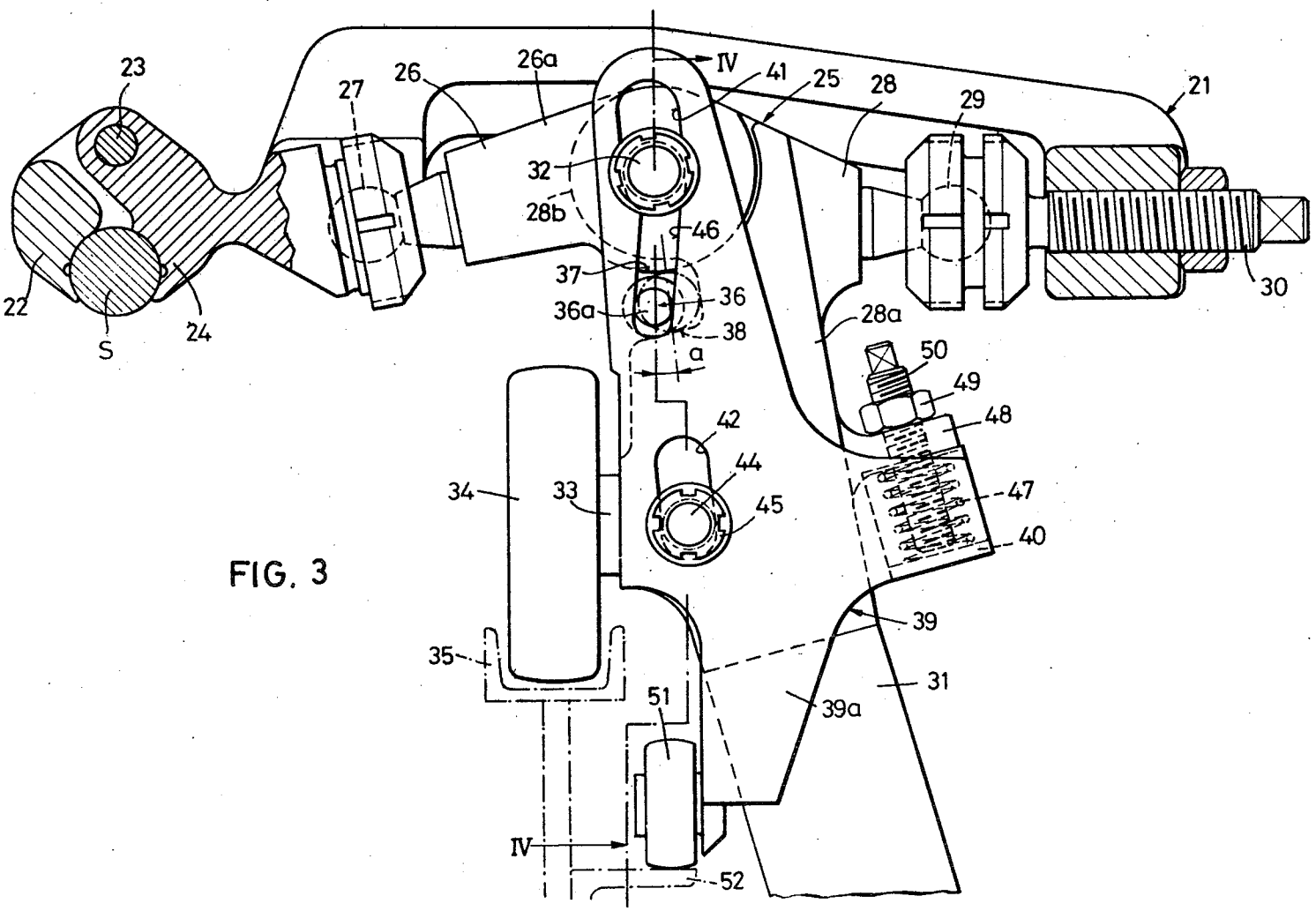
FIG. 3 is a sketch of the preferred, second clamp coupling design in which the parts are shown in their relative position to one another, in a circular suspension railway station shortly before detachment of the clamp coupling from the support and haulage cable.
Figure 4:
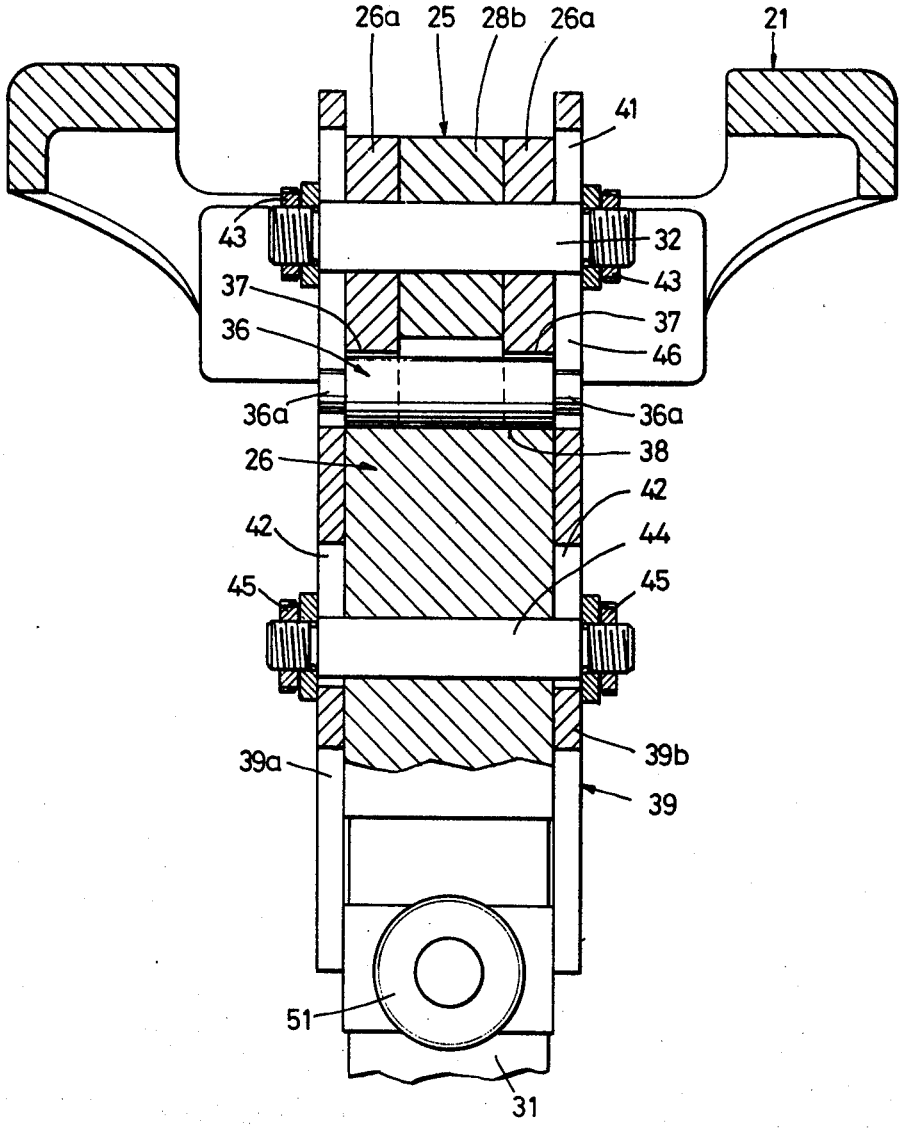
FIG. 4 is a section along line IV—IV of FIG. 3.

The clamp coupling design shown in FIGS. 3 and 4 differs only slightly from the previously described design. There is provided a frame-shaped rack 21 on which a single piece clamp jaw is firmly affixed and on which, with the further help of an axle bolt 23, a mobile clamp jaw 24 is mounted in rotating fashion. Inside the frame opening of the rack 21 is a toggle lever mechanism 25, whose one lever 26 has a spherical head 27 which like a ball joint lies against a ball socket which is built onto a manable clamp jaw 24. The other lever 28 has a spherical head 29 adjacent to a ball socket which is built onto a screw adjustable part 30 located in rack 21. The lever 28 has a part 28*a* protruding in a downward diagonal direction which is rigidly welded onto suspension gear support bar 31. In the place where the levers 26, 28 are hinged to one another, lever 26 is forked to provide fork branches or bearing eyes 26*a* on both sides of a middle single bearing eye 28*b* of lever 28. A hinge bolt 32 is provided for adjacent mounting of the levers. The lever part 28*a* projects in a downward diagonal and carries a firmly secured support pin 33 on which a roller 34 is rotatably mounted. In the circular suspension railway stations, this roller runs up onto a rail 35 (illustrated in FIG. 3 by broken lines) and causes a lifting of lever part 28*a* along with suspension gear bar 31 and thus a buckling of elbow lever mechanism 25 and accordingly a loosening of mobile clamp jaw 24 from support and haulage cables. The position of lever 26 and 28 immediately in front of the opening and suspension gear support bar 31 is illustrated in FIG. 3. Thus far, this clamp coupling corresponds very closely to the previously described clamp coupling as regards construction and mode of operation. This further developed clamp coupling, however, has a device which provides an automatic blocking barrier to prevent involuntary buckling of the toggle lever mechanism and a device for removing this barrier prior to actuation of the clamp coupling in the open mode. This is described in detail as follows:

The main component of the automatic barrier is a cylindrical locking bolt 36 having an axis which runs parallel to the hinge axis of the toggle lever mechanism 25. In other words, its axis runs parallel to the geometric axis of hinge bolt 32. On the one hand the locking bolt 36, works in collaboration with a surface 37 concentric to this hinge axis located on the underside of both bearing eyes 28*b* of the lever 26 which actuates the mobile clamp jaw 24 on the other hand, the locking bolt 36 works with a locking surface 38 section of the lever part 28*a* which is attached to the suspension gear bar. This locking surface is inclined so slightly opposite the operative part of surface 37 that it guarantees an obstructive clamping of locking bolt 36. When a cross wind hits suspension gears located outside stations when the line is clear, in such a direction (seen in FIG. 3 from right to left) that a torque occurs on lever 28 of the toggle lever mechanism 25 around the axis of the toggle lever mechanism which is in opposition to the weight momentum and attempts to crack upwards through this mechanism to thus loosen the clamp jaw 24 from the support and haulage cable S, locking bolt 36 gets in the way of such an upward cracking.

As locking surface 38 is slightly inclined, as in FIG. 3, the locking bolt cannot escape from its operating position. It takes special means to get it into this operating position and also to take it out of its locking position in the stations where loosening of clamp jaw 24 from support and haulage cable S is necessary. Means are therefor provided for setting up the barrier when the clamp coupling is activated in the closed mode and for raising the barrier by activation of the clamp coupling in the open mode. These means are now described in detail. The main component is an activation component with plate-shaped side sections 39 located on both sides of lever section 28*a* and rigidly connected with one another by a U-shaped iron piece 40 which is welded onto them. These side parts seen in FIG. 3, one behind the other forming a unit, each have at a distance, one beneath the other, two longish, parallel steering apertures 41 and 42. Steering apertures 41 grip end sections of hinge bolt 32 on which end sections there are also screw extensions having nuts secured thereon to prevent loosening. A bolt 44 similar to hinge bolt 32 passes through lever part 28*a* in the vicinity of support pin 33 and has end pieces which are gripped by steering apertures 42 and also has screw extensions with nuts 45 thereon. The activation component 39 is thus driven back and forth towards the longitudinal middle plane of steering apertures 41 and 42 in a sliding mode on lever 28 or lever part 28*a*. Each of the two side sections 39*a* and 39*b* has a longish lead opening 46 into which a corresponding end pin 36*a* of locking bolt 36 passes. The common longitudinal middle plane of the two lead apertures 46 is inclined towards the aforementioned common longitudinal middle plane of lead apertures 41, 42 at an angle *a* so that a downward displacement of activation component 39 attempts to slide the locking bolt into its operating position against which an upward displacement of activation component 39 moves locking bolt 36 out of its operating position. The downward displacement of activation component 39 occurs primarily under heavy operation, but in the example illustrated is supported by a spring 47 which is operative between the flange of the U-iron 40 and flap 48 welded onto lever part 28*a*. This flap has a thread hole into which a stop screw 50 is inserted and the stop screw is secured by a nut 49 which works in conjunction with the flange of the U-iron 40 to prevent excessive upward displacement of the activation component in relation to lever 28. This could occur if a trolley 51, which is mounted on the lowest part of the activation component 39, ran up into one of the circular suspension railway stations onto an adjoining control rail 52.

The purpose of this control rail is obviously to bring about the aforementioned upward displacement of the activation member 39 with regard to lever part 28 for the purpose of moving locking bolt 39 out of its operating position so that guide rail 34 can then, by running up onto rail 35, move lever part 28*a* upwards in order to thus crack upwards through the elbow lever mechanism and thus loosen mobile clamp jaw 24 from support and haulage cable S.

Many changes could be made on the examples described. In the first place, spherical hinges 5*a*, 7*b* and 8*b*, 9*a* (FIGS. 1 and 2) or 27 and 29, respectively (FIGS. 3 and 4) could be replaced by cardan joints. It would also be conceivable to develop the activation member 39 as an angle lever with side parts which, similar to side parts 39*a* and 39*b*, would be placed on either side of lever part 28*a* and be mounted on lever part 28 by means of a support bolt which would replace bolt 44. Both side parts would then each have a forked opening into which the end pins of locking bolt 36 would pass and spring 47 would then load the bell crank in the movement direction of the locking bolt. The diagonally projecting arm of the bell crank would then carry guide rail 51, which would then work in conjunction with a control rail to be set up in the stations to move locking bolt 36 out of its operating position. Such a formation would, however, be less advantageous than that described in detail in FIGS. 3 and 4.

Although preferred embodiments of this invention are illustrated, it should be understood that various modifications and rearrangements of parts may be resorted to without departing from the scope of the invention disclosed and claimed herein.

What is claimed is:

1. In a suspension gear of a continuous wire ropeway which includes a haulage-and-support cable, wherein the coupling of the suspension gear to said haulage-and-support cable is effected and sustained by the net weight of the suspension gear, a clamp coupling comprising a rack, a fixed clamp jaw firmly affixed to said rack, a movable clamp jaw mounted on said rack, a suspension gear support bar, a control carriage, and a toggle lever mechanism connecting said movable clamp to said suspension gear support bar and to said control carriage, said toggle lever mechanism being supported on said rack and including a first and a second lever, two universal joints respectively connecting one of the levers to a portion of said rack spaced from said clamp jaws and connecting the other one of said first and second levers to said movable clamp jaw, said first and second levers being hinged to one another about an axis which extends at right angles to the longitudinal axis of said support bar and also at right angles to a straight line extending between the centers of said two universal joints, one of said first and second levers of said toggle lever mechanism which is mounted on said portion of said rack that is spaced from said clamp jaws being rigidly attached to said support bar, the improvement comprising obstruction device means for automatically preventing said toggle lever mechanism from buckling upwardly upon the application of side loads on said support bar, and means for setting up said obstruction device for operation after actuation of the movable clamp jaw of said clamp coupling towards its closed position and for rendering said obstruction device inactive before actuation of said movable clamp jaw of said clamp coupling towards its open position.

2. An arrangement as set forth in claim 1, wherein said obstruction device comprises a lock bolt (36), the longitudinal axis of which runs parallel to a hinge axis of said toggle lever mechanism (25) on the one hand, said lock bolt being arranged for engagement on a rest surface (37) concentric to said hinge axis on at least one bearing eye (26*a*) of that one (26) of said two levers of said toggle lever mechanism which is operatively connected to said movable clamp jaw (24) and, on the other hand, with a lock surface (38) on that arm, (28*a*) of said one lever rigidly attached to said support bar (31) which adjoins said support bar, said lock surface (38) being so slightly inclined to the oppositely facing portion of said rest surface that a self-locking obstructive clamping of said lock bolt is assured.

3. An arrangement as set forth in claim 2, wherein said lock bolt (36) has a pin section at each end, further comprising an actuating member (39) having side sections (39*a*, 39*b*) located on either side of said lever arm (28*a*) adjoining said support bar (31), a roller (51) being carried by said actuating member and adapted to run up onto an adjoining stationary guide rail (52) of the ropeway, said side sections each having a longitudinal control opening (46) for a respective one of the pin sections of said lock bolt, the longitudinal direction of said control openings extending substantially at a right angle to said rest surface (37) on said at least one bearing eye.

4. The arrangement as set forth in claim 3, further comprising a spring (47) disposed between said lever arm (28*a*) which adjoins said support bar, on the one hand, and said actuating member (39) on the other hand, said spring acting to support the weight of said actuating member to move same downwardly each time said actuating member leaves a said stationary guide rail.

* * * * *